US010632785B2

(12) United States Patent
Tuzi

(10) Patent No.: US 10,632,785 B2
(45) Date of Patent: Apr. 28, 2020

(54) PAINT HOLDER AND/OR PAINT APPLICATOR

(71) Applicant: Luigi Tuzi, Richmond Hill (CA)

(72) Inventor: Luigi Tuzi, Richmond Hill (CA)

( * ) Notice: Subject to any disclaimer, the term of this patent is extended or adjusted under 35 U.S.C. 154(b) by 190 days.

(21) Appl. No.: 15/707,344

(22) Filed: Sep. 18, 2017

(65) Prior Publication Data

US 2018/0117956 A1 May 3, 2018

(30) Foreign Application Priority Data

Nov. 2, 2016 (CA) ..... 2947256

(51) Int. Cl.
*B44D 3/12* (2006.01)
*B44D 3/14* (2006.01)

(52) U.S. Cl.
CPC ..... *B44D 3/123* (2013.01); *B44D 3/125* (2013.01); *B44D 3/126* (2013.01); *B44D 3/14* (2013.01)

(58) Field of Classification Search
CPC ..... B44D 3/123; B44D 3/125; B44D 3/126; B44D 3/14
See application file for complete search history.

(56) References Cited

U.S. PATENT DOCUMENTS

| | | | | |
|---|---|---|---|---|
| 3,757,990 | A | 9/1973 | Buth | |
| 3,832,749 | A | 9/1974 | Hawk | |
| 3,870,420 | A * | 3/1975 | Hawk | B44D 3/126 401/121 |
| 4,025,205 | A * | 5/1977 | Hawk | B44D 3/126 401/121 |
| 4,364,143 | A | 12/1982 | Uhl | |
| 4,757,568 | A | 7/1988 | Jones | |
| 4,835,812 | A | 6/1989 | Su | |
| 6,196,410 | B1 | 3/2001 | Hocking | |
| 7,854,341 | B2 * | 12/2010 | Martin | B44D 3/126 220/23.86 |
| 7,963,418 | B2 | 6/2011 | Arvinte et al. | |
| 8,256,638 | B2 | 9/2012 | Arvinte et al. | |
| 2003/0126711 | A1 | 7/2003 | Korenevsky | |
| 2013/0186902 | A1 | 7/2013 | Bar-Shlomo | |
| 2014/0096338 | A1 | 4/2014 | Enguita | |
| 2017/0268720 | A1 * | 9/2017 | Rogers | B65D 1/34 |

* cited by examiner

*Primary Examiner* — Shay Karls

(57) ABSTRACT

An apparatus includes a paint holder configured for utilization with a paint applicator, in which the paint applicator has an applicator-engagement feature. The paint holder has a paint-receiving zone configured to receive paint therein. The paint holder has a vertically-extending side wall, in which the vertically-extending side wall surrounds, at least in part, the paint-receiving zone. The paint holder has a holder-engagement feature configured to selectively engage with, and selectively disengage from, the applicator-engagement feature of the paint applicator.

2 Claims, 7 Drawing Sheets

PAINT HOLDER AND/OR PAINT APPLICATOR

TECHNICAL FIELD

Figure 1:
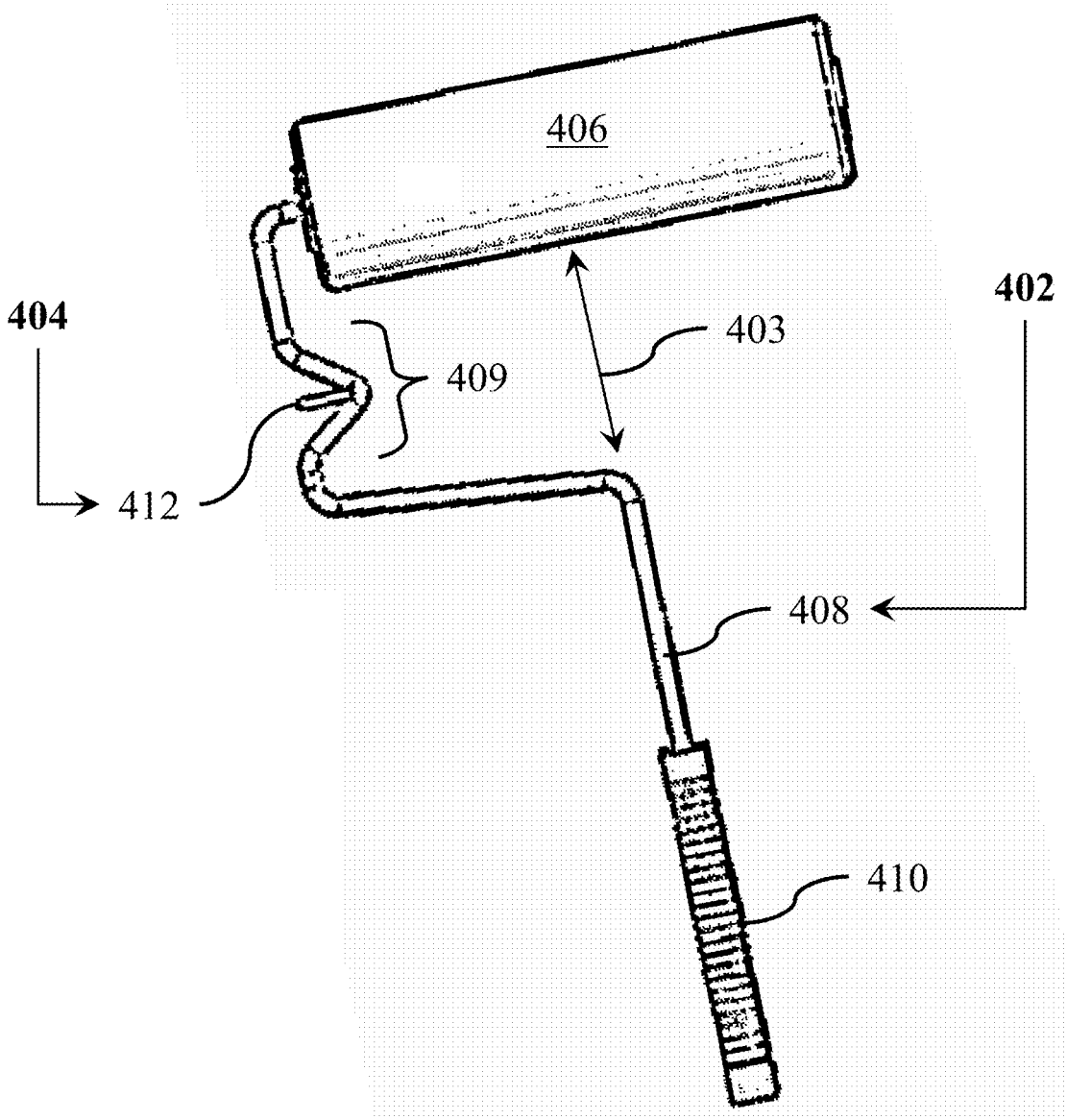

This document relates to the technical field of (and is not limited to) paint tools, such as paint applicators and/or paint holders (and method therefor).

BACKGROUND

Paint tools may include a paint applicator and/or a paint holder. A paint brush and/or a paint roller is an example of a paint applicator (also called a paint-application tool). The paint applicator is configured to apply a layer of paint to a surface. A paint tray and/or a paint liner are examples of a paint holder. The paint holder is configured to receive and hold paint (from which the paint applicator is utilized to obtain the paint from the paint holder).

SUMMARY

It will be appreciated that there exists a need to mitigate (at least in part) at least one problem associated with the existing paint applicators and/or paint holders (also called the existing technology). After much study of the known systems and methods with experimentation, an understanding (at least in part) of the problem and its solution has been identified (at least in part) and is articulated (at least in part) as follows:

Moving existing paint holders (while the paint holder, in use, receives and holds the paint) from one place to another may be inconvenient for a user (a painter), who holds an existing paint applicator in hand. Existing conditions (known technology) require the painter to put down and release the paint applicator, then move the paint holder from an existing location to a new location, and then pick up the paint applicator and resume painting activities with the paint applicator in hand. This existing condition results in wasted time and effort, and adds to the overall painting time required to complete a paint job.

What may be needed is a way for the painter to move a paint holder (while the paint holder, in use, receives and holds the paint) from one place to another without having to release the paint applicator while the paint holder is being moved from one place to another. In this manner, the painter does not have to put down and release the paint applicator while the paint holder is moved from an existing location to a new location. This solution may result in less wasted time and effort, and reduces, at least in part, the overall painting time required to complete a paint job.

What may be required is a paint holder and a paint applicator configured to selectively engage with, and selectively disengage from, each other in such a way that the paint applicator is usable, by a user, for moving the paint holder from one place to another while the paint holder, in use, receives and holds the paint (while the paint holder and the paint applicator are selectively engaged with each other, and while the user continues to grasp the paint applicator). In this manner, the painter does not have to put down and release the paint applicator while the paint holder is moved from an existing location to a new location. This solution may result in less wasted time and effort, and reduces, at least in part, the overall painting time required to complete a paint job.

To mitigate, at least in part, at least one problem associated with the existing technology, there is provided (in accordance with a major aspect) an apparatus.

The apparatus includes and is not limited to (comprises) a paint holder configured for utilization with a paint applicator. The paint applicator has an applicator-engagement feature. The paint holder has a paint-receiving zone configured to receive paint therein. The paint holder has a vertically-extending side wall. The vertically-extending side wall surrounds, at least in part, the paint-receiving zone. The paint holder has a holder-engagement feature configured to selectively engage with, and selectively disengage from, the applicator-engagement feature of the paint applicator.

This is done in such a way that the paint holder is movable from one place to another place in response to a user, in use, moving the paint applicator while the paint holder, in use, receives and holds the paint, and while the paint holder and the paint applicator remain selectively engaged with each other, and while the user continues to grasp the paint applicator. In this manner, the user (also called the painter) does not have to put down and release the paint applicator while the paint holder is moved from an existing location to a new location. This solution may result in less wasted time and effort, and reduces, at least in part, the overall painting time required to complete a paint job.

To mitigate, at least in part, at least one problem associated with the existing technology, there is provided (in accordance with a major aspect) an apparatus.

The apparatus includes and is not limited to (comprises) a paint applicator configured for utilization with a paint holder. The paint holder has a paint-receiving zone configured to receive paint therein. The paint holder has a vertically-extending side wall surrounding, at least in part, the paint-receiving zone. The paint holder has a holder-engagement feature. The paint applicator has an applicator-engagement feature configured to selectively engage with, and selectively disengage from, the holder-engagement feature of the paint holder. This is done in such a way that the paint applicator is usable, by a user, for moving the paint holder from one place to another place while the paint holder, in use, receives and holds the paint, and while the paint holder and the paint applicator remain selectively engaged with each other, and while the user continues to grasp the paint applicator. In this manner, the user (also called the painter) does not have to put down and release the paint applicator while the paint holder is moved from an existing location to a new location. This solution may result in less wasted time and effort, and reduces, at least in part, the overall painting time required to complete a paint job.

To mitigate, at least in part, at least one problem associated with the existing technology, there is provided (in accordance with a major aspect) a method.

The method includes and is not limited to (comprises) utilizing a paint holder with a paint applicator, in which the paint applicator has an applicator-engagement feature, in which the paint holder has a paint-receiving zone configured to receive paint therein, and in which the paint holder has a vertically-extending side wall, and in which the vertically-extending side wall surrounds, at least in part, the paint-receiving zone. The method also includes selectively engaging a holder-engagement feature of the paint holder with the applicator-engagement feature of the paint applicator. This is done in such a way that the paint applicator is usable, by a user, for moving the paint holder from one place to another place while the paint holder, in use, receives and holds the paint, and while the paint holder and the paint applicator remain selectively engaged with each other, and while the user continues to grasp the paint applicator. In this manner, the user (also called the painter) does not have to put down and release the paint applicator while the paint holder is moved from an existing location to a new location. This solution may result in less wasted time and effort, and reduces, at least in part, the overall painting time required to complete a paint job. The method also includes selectively disengaging the holder-engagement feature of the paint holder from the applicator-engagement feature of the paint applicator.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

DETAILED DESCRIPTION OF THE DRAWINGS

Figure 2:
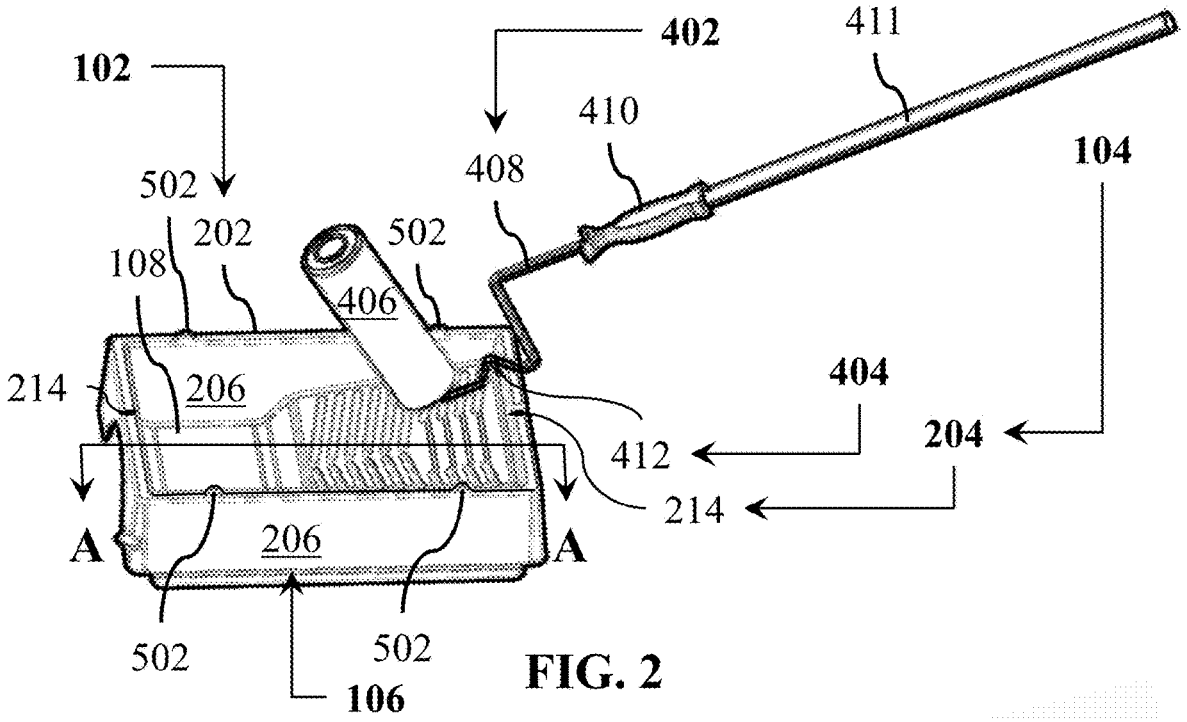
Figure 3:
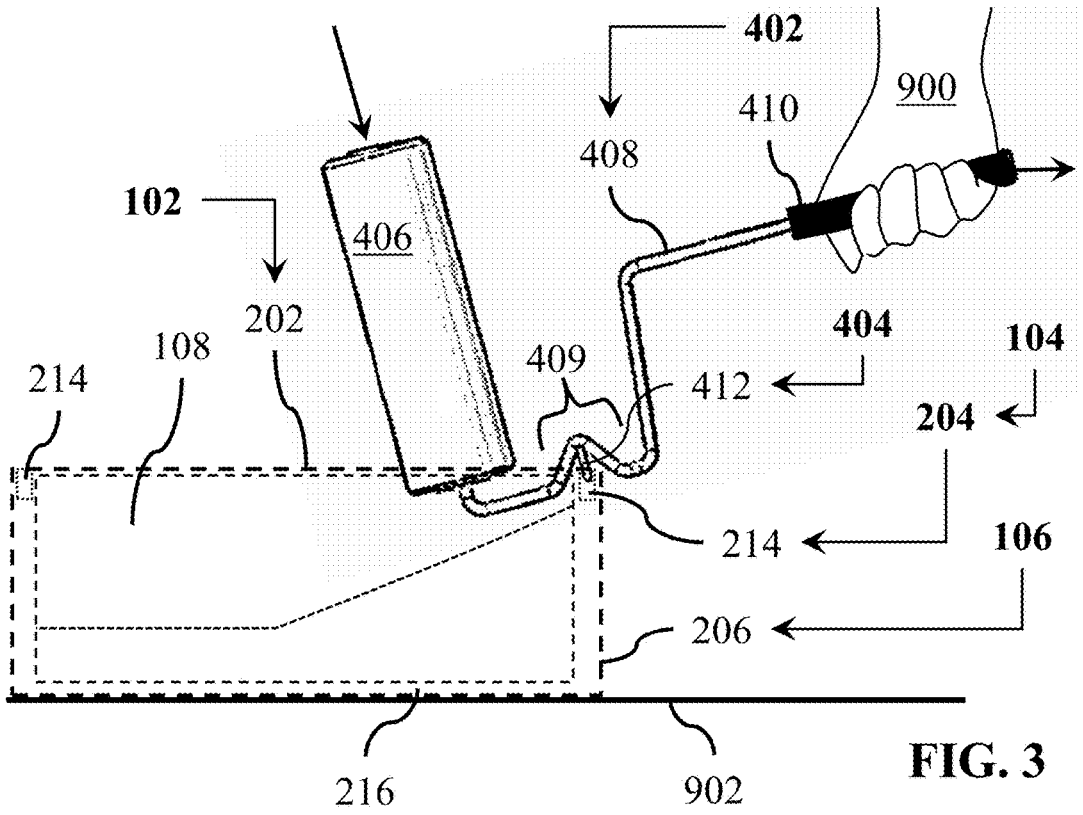
Figure 4:
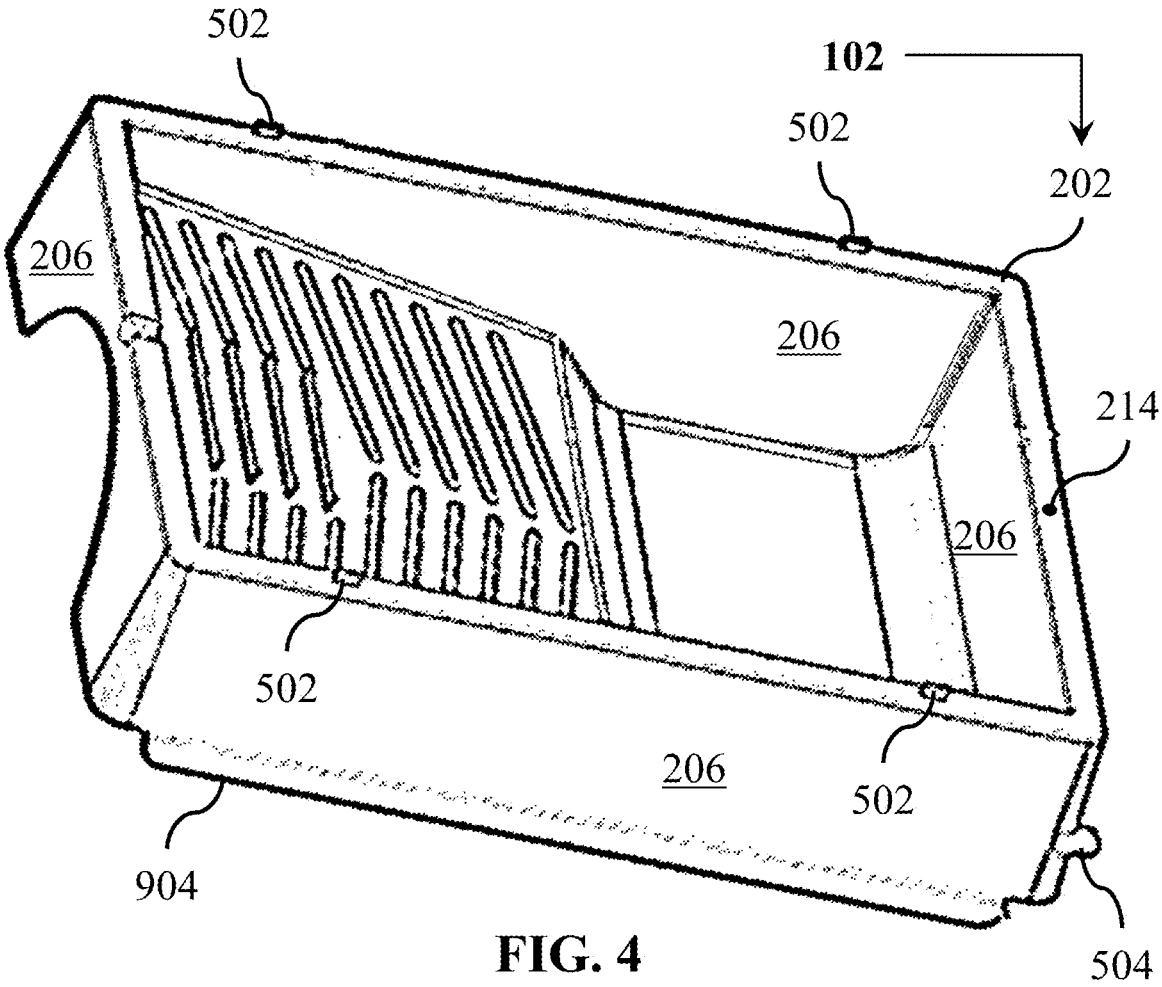
Figure 5:
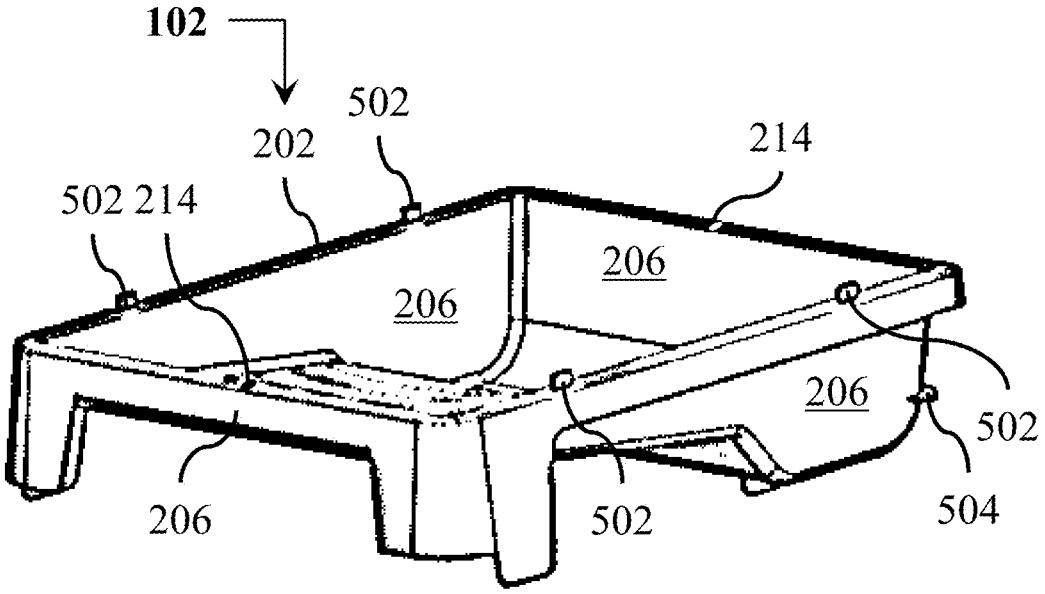
Figure 6:
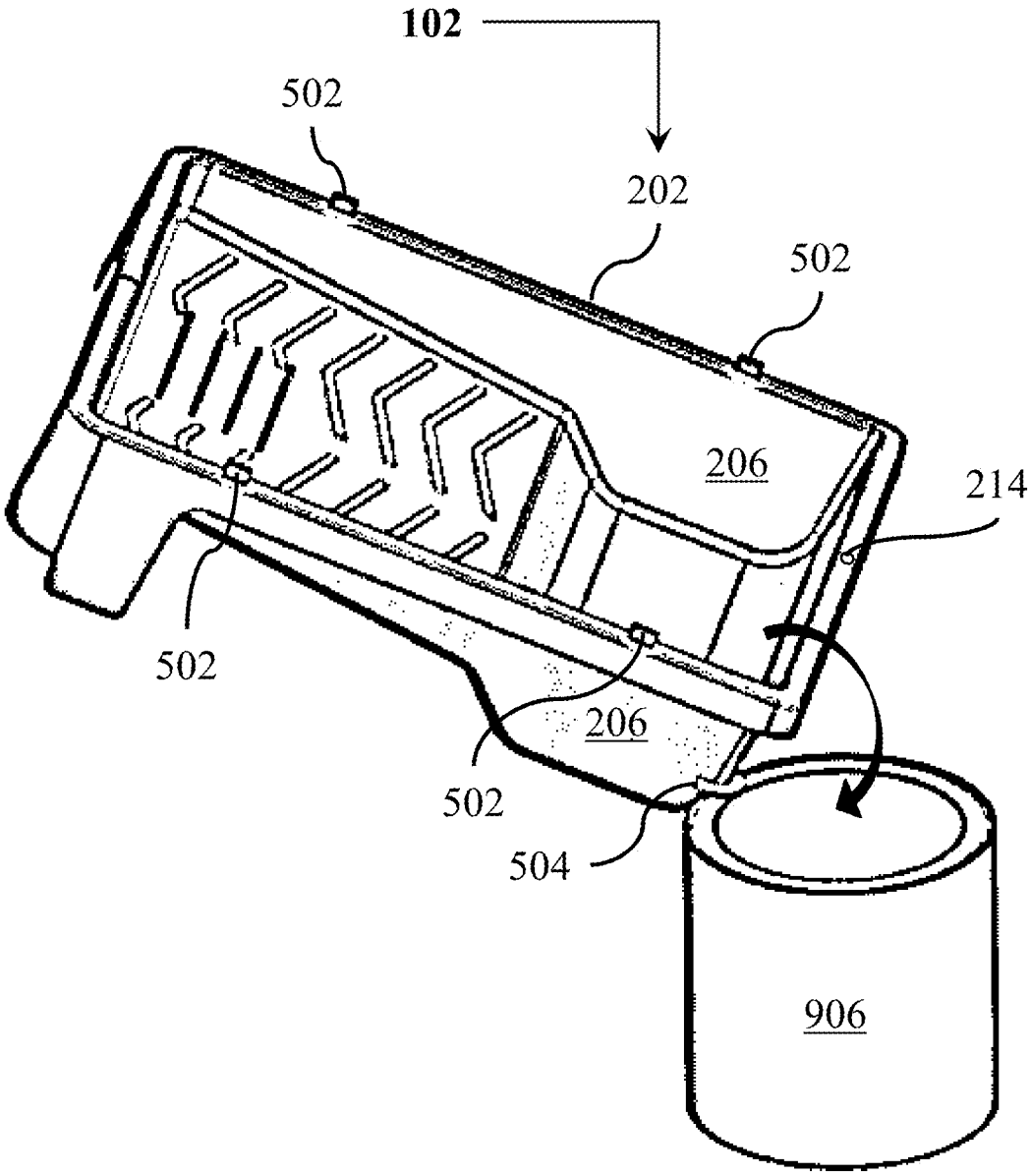
Figure 7:
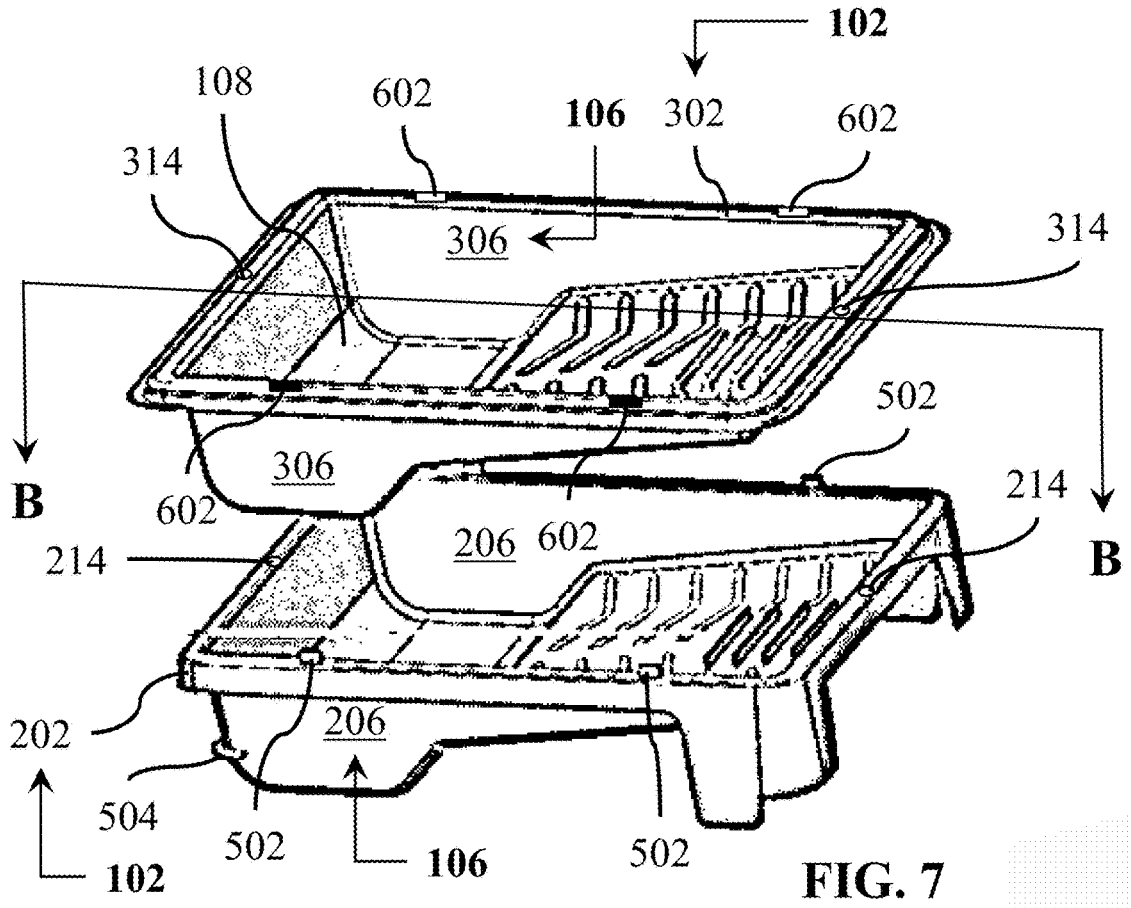
Figure 8:
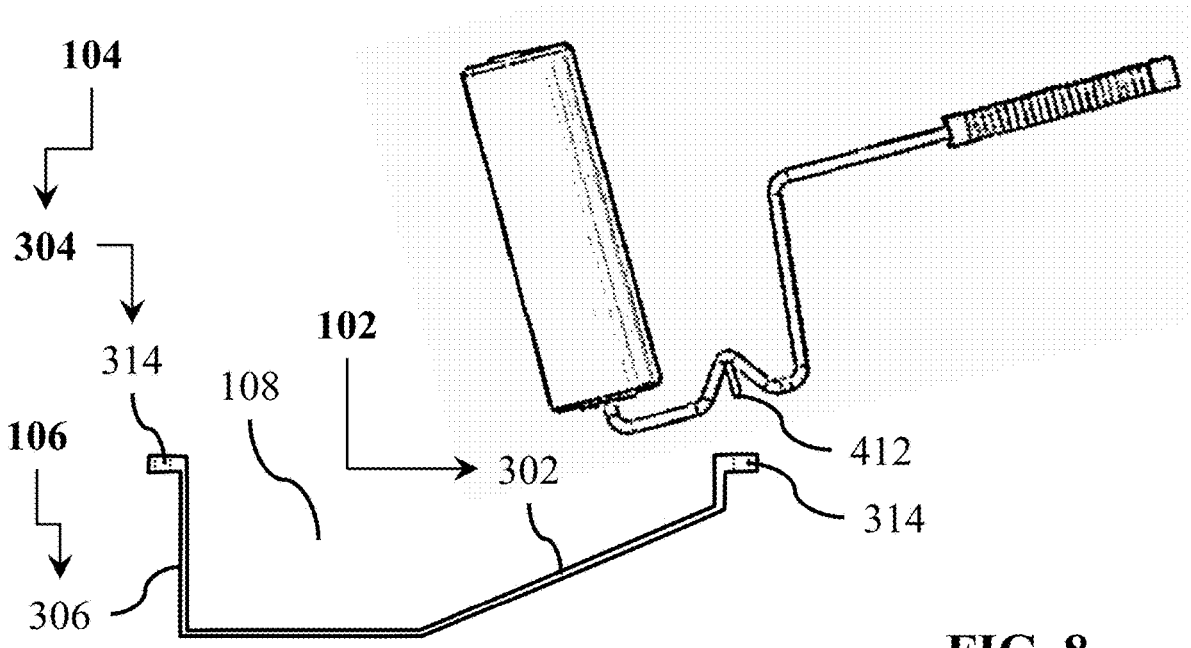
Figure 9:
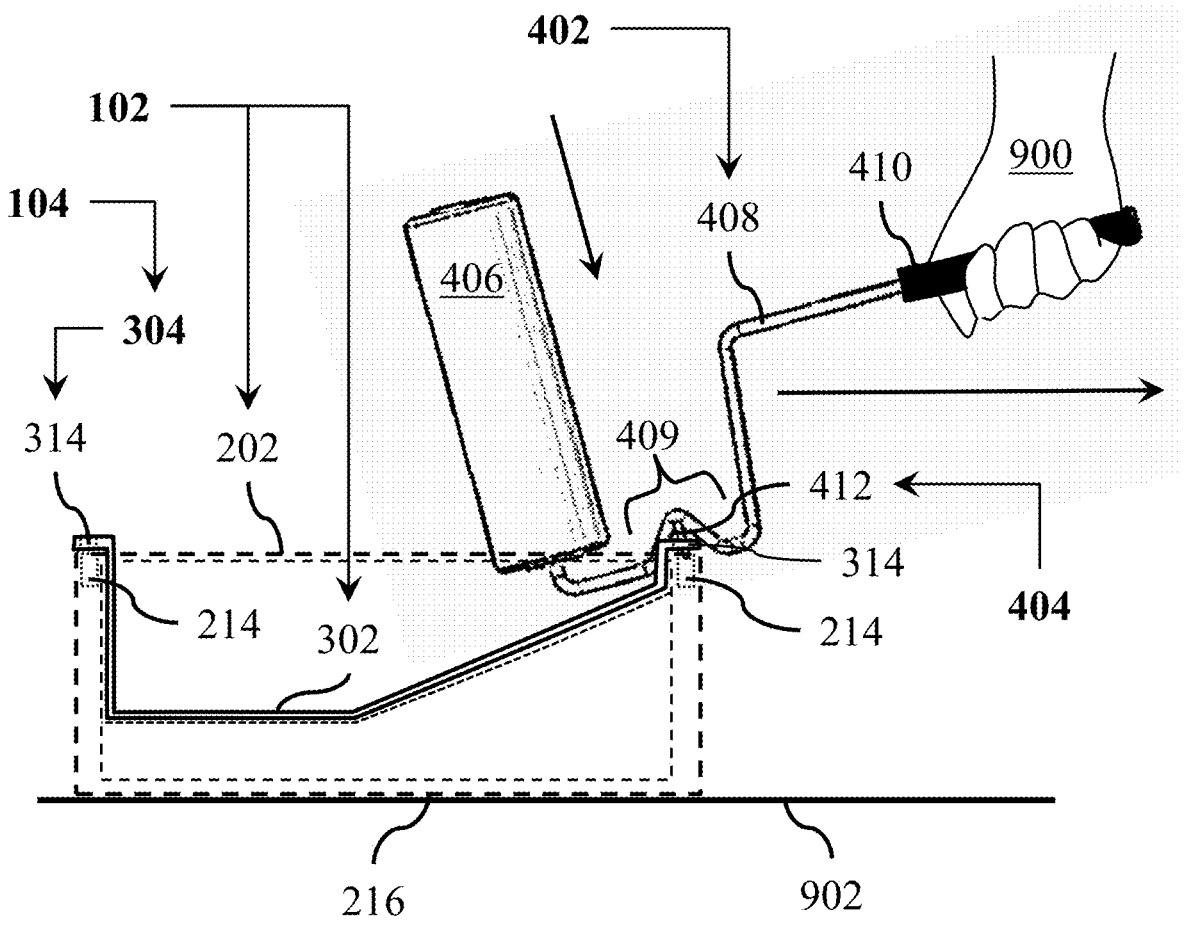
Figure 10:
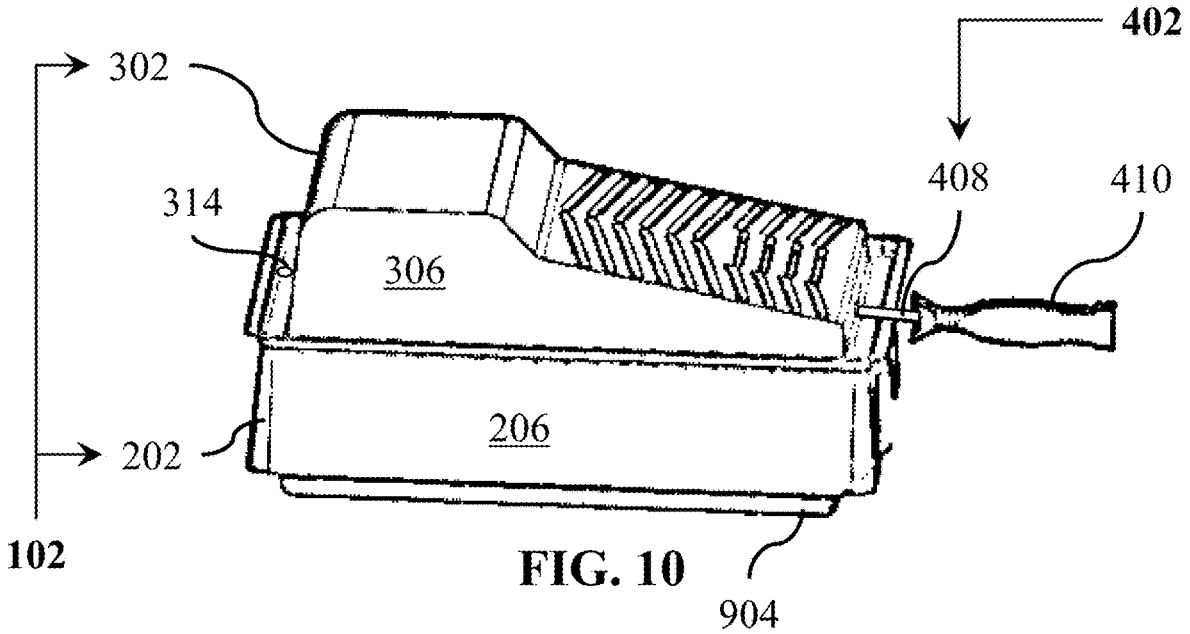
Figure 11:
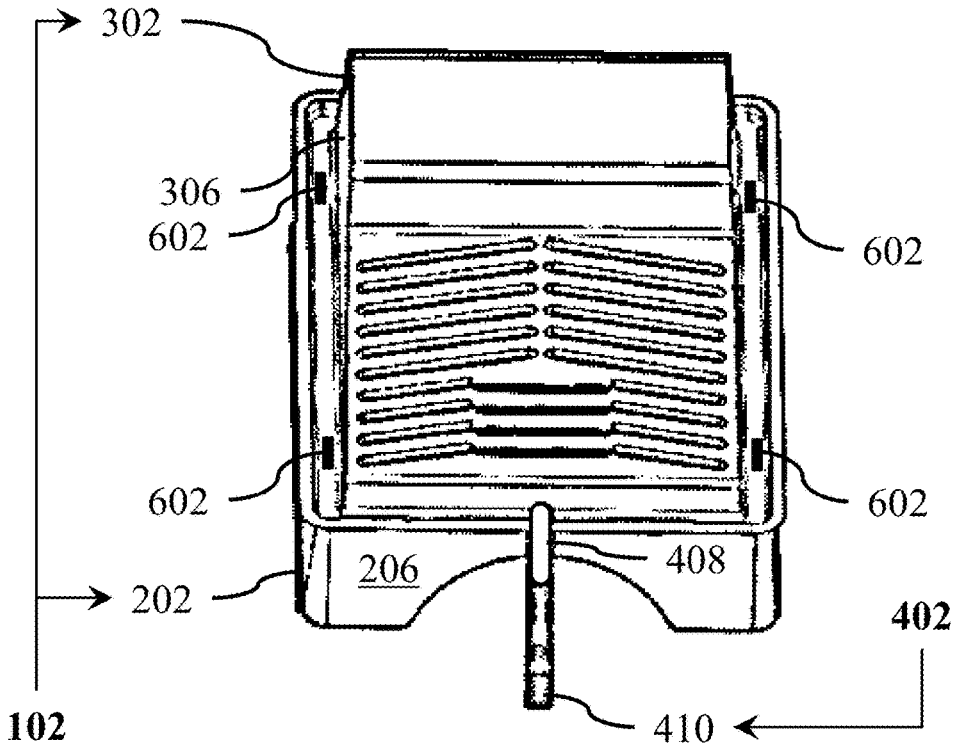

The non-limiting embodiments may be more fully appreciated by reference to the following detailed description of the non-limiting embodiments when taken in conjunction with the accompanying drawings, in which:

FIG. 1 (SHEET 1 of 7 SHEETS) depicts a side view of an embodiment of a paint applicator (in which, for a preferred embodiment, the paint applicator includes a paint roller); and FIG. 2 and FIG. 3 (SHEET 2 of 7 SHEETS) depict a perspective view (FIG. 2) and a cross-sectional view (FIG. 3) of embodiments of a paint holder (in which, for preferred embodiments, the paint holder includes a paint tray), and also depict embodiments of the paint applicator of FIG. 1; and FIG. 4 and FIG. 5 (SHEET 3 of 7 SHEETS) depict perspective views of embodiments of the paint holder of FIG. 2 (in which, for preferred embodiments, the paint holder includes a paint tray); and FIG. 6 (SHEET 4 of 7 SHEETS) depicts a perspective view of an embodiment of the paint holder of FIG. 2 (in which, for a preferred embodiment, the paint holder includes a paint tray); and FIG. 7 (SHEET 5 of 7 SHEETS) depicts a perspective view of embodiments of the paint holder of FIG. 2 (in which, for a preferred embodiment, the paint holder includes any one, or both, of a paint tray and a paint liner), and also depicts an embodiment of the paint applicator of FIG. 1; and FIG. 8 (SHEET 5 of 7 SHEETS) depicts a cross-sectional view of embodiments of the paint holder of FIG. 2 (in which, for a preferred embodiment, the paint holder includes a paint liner), and also depicts an embodiment of the paint applicator of FIG. 1; and FIG. 9 (SHEET 6 of 7 SHEETS) depicts a cross-sectional view (taken along a cross-sectional line A-A of FIG. 7) of embodiments of the paint holder of FIG. 2, (in which, for a preferred embodiment, the paint holder includes any one, or both, of a paint tray and a paint liner), and also depicts an embodiment of the paint applicator of FIG. 1; and FIG. 10 and FIG. 11 (SHEET 7 of 7 SHEETS) depict perspective views of embodiments of the paint holder of FIG. 2 (in which, for a preferred embodiment, the paint holder includes any one, or both, of a paint tray and a paint liner), and also depict embodiments of the paint applicator of FIG. 1.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

102 paint holder
104 holder-engagement feature
106 vertically-extending side wall
108 paint-receiving zone
202 paint tray
204 tray-engagement feature
206 vertically-extending tray side wall
214 tray channel
216 bottom floor
302 paint liner
304 liner-engagement feature
306 vertically-extending liner side wall
314 liner channel
402 paint applicator
403 distance
404 applicator-engagement feature
406 paint roller
408 shaft
409 v-shaped shaft portion
410 handle
411 extension shaft
412 pin
502 tray-engagement feature
504 ledge portion
602 liner-engagement feature
900 user
902 working surface
904 elongated sliders
906 paint storage bin

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

FIG. 1 depicts a side view of an embodiment of a paint applicator 402. In accordance with a preferred embodiment (as depicted in FIG. 1), the paint applicator 402 includes (and is not limited to) a paint roller 406.

FIG. 2 and FIG. 3 depict a perspective view (FIG. 2) and a cross-sectional view (FIG. 3, in which the cross-sectional view is taken along a cross-sectional line A-A of FIG. 2) of embodiments of a paint holder 102, and also depict embodiments of the paint applicator 402 of FIG. 1. In accordance with preferred embodiments (as depicted in FIG. 2 and FIG. 3), the paint holder 102 includes (and is not limited to) a paint tray 202.

Referring to the embodiments as depicted in FIG. 1 and FIG. 2, the paint applicator 402 may include (and is not limited to), for instance, a paint roller 406, a paint brush, etc., and any equivalent thereof. The paint applicator 402 is configured for utilization with the paint holder 102. The paint holder 102 may include (and is not limited to), for instance, a paint tray 202, a paint liner 302 or both and any equivalent thereof. The paint holder 102 has a paint-receiving zone 108 configured to receive paint therein. The paint holder 102 has a vertically-extending side wall 106 surrounding, at least in part, the paint-receiving zone 108. The paint holder 102 has a holder-engagement feature 104 (such as and not limited to, a hole, etc., and any equivalent thereof). The paint applicator 402 has an applicator-engagement feature 404 configured to selectively engage with, and selectively disengage from, the holder-engagement feature 104 of the paint holder 102. For instance, the applicator-engagement feature 404 may include and is not limited to a peg extending from a portion of the paint applicator 402 (such as, from a shaft 408 or shaft portion of the paint applicator 402). This is done in such a way that the paint applicator 402 is usable, by a user 900, for moving the paint holder 102 from one place to another place while the paint holder 102, in use, receives and holds the paint, and while the paint holder 102 and the paint applicator 402 remain selectively engaged with each other, and while the user 900 continues to grasp the paint applicator 402. In this manner, the user 900 (also called the painter) does not have to put down and release the paint applicator 402 while the paint holder 102 is moved from an existing location to a new location. This solution may result in less wasted time and effort, and reduces, at least in part, the overall painting time required to complete a paint job.

In accordance with the embodiment as depicted in FIG. 1, the paint applicator 402 includes (and is not limited to) a paint roller 406, a shaft 408, and a handle 410. The shaft 408 extends from (and end portion of) the handle 410. The paint roller 406 is configured to be selectively rotatably mounted to the shaft 408. The applicator-engagement feature 404 extends from the shaft 408, such as a side portion of the shaft 408.

In accordance with the embodiment as depicted in FIG. 1, the applicator-engagement feature 404 includes (and is not limited to) a pin 412, in which the pin 412 extends from the shaft 408.

In accordance with the embodiment as depicted in FIG. 1, the shaft 408 includes a V-shaped shaft portion 409 that faces (opens) laterally away from one end portion of the paint roller 406. A pin 412 is fixedly connected to, and extends from, about the middle of the V-shaped shaft portion 409. The pin 412 extends laterally away from one end portion of the paint roller 406. Preferably, the pin 412 is aligned parallel to the lateral axis that extends between opposite ends of the paint roller 406. Preferably, the pin 412 has a circular cross-sectional profile. The V-shaped shaft portion 409 is shaped to protect (guard) the pin 412 from inadvertent (unwanted) damage. Generally, the pin 412 connects to and extends from a side portion of the shaft 408.

Referring to the embodiments as depicted in FIG. 2 and FIG. 3, the paint holder 102 may include and is not limited to a paint-holding device, a paint tray 202, a paint liner 302, etc., and any equivalent thereof. The paint holder 102 is configured for utilization with the paint applicator 402 (such as, a paint-application device, a paint roller 406, paint brush, etc.). The paint applicator 402 has an applicator-engagement feature 404 (such as a peg extending from a shaft 408 or shaft portion thereof). The paint holder 102 has (defines) the paint-receiving zone 108 (also called a paint well) configured to receive paint therein. The paint holder 102 has a vertically-extending side wall 106. The vertically-extending side wall 106 surrounds, at least in part, the paint-receiving zone 108. The paint holder 102 has a holder-engagement feature 104 (such as a hole, etc.) configured to selectively engage with, and selectively disengage from, the applicator-engagement feature 404 of the paint applicator 402. This is done in such a way that the paint holder 102 is movable from one place to another place in response to a user 900, in use, moving the paint applicator 402 while the paint holder 102, in use, receives and holds the paint, and while the paint holder 102 and the paint applicator 402 remain selectively engaged with each other, and while the user 900 continues to grasp the paint applicator 402. In this manner, the user 900 (also called the painter) does not have to put down and release the paint applicator 402 while the paint holder 102 is moved from an existing location to a new location. This solution may result in less wasted time and effort, and reduces, at least in part, the overall painting time required to complete a paint job.

In accordance with preferred embodiments (as depicted in FIG. 2 and FIG. 3), there is provided a method of utilizing the paint holder 102 with the paint applicator 402. The method includes and is not limited to selectively engaging a holder-engagement feature 104 of the paint holder 102 with the applicator-engagement feature 404 of the paint applicator 402. This is done in such a way that the paint applicator 402 is usable, by a user 900, for moving the paint holder 102 from one place to another place while the paint holder 102, in use, receives and holds the paint, and while the paint holder 102 and the paint applicator 402 remain selectively engaged with each other, and while the user 900 continues to grasp the paint applicator 402. In this manner, the user 900 (also called the painter) does not have to put down and release the paint applicator 402 while the paint holder 102 is moved from an existing location to a new location. This solution may result in less wasted time and effort, and reduces, at least in part, the overall painting time required to complete a paint job.

The method also includes and is not limited to selectively disengaging the holder-engagement feature 104 of the paint holder 102 from the applicator-engagement feature 404 of the paint applicator 402.

In accordance with the embodiments as depicted in FIG. 2 and FIG. 3, the holder-engagement feature 104 is positioned proximate to the vertically-extending side wall 106.

In accordance with the embodiments as depicted in FIG. 2 and FIG. 3, the holder-engagement feature 104 is positioned at a top portion of the vertically-extending side wall 106.

In accordance with the embodiments as depicted in FIG. 2 and FIG. 3, the holder-engagement feature 104 includes (and is not limited to) a tray-engagement feature 204. The paint holder 102 includes (and is not limited to) a paint tray 202, in which in the tray-engagement feature 204 is located on the paint tray 202.

In accordance with the embodiments as depicted in FIG. 2 and FIG. 3, the tray-engagement feature 204 includes (and is not limited to) a tray channel 214 defined by the paint tray 202.

In accordance with the embodiments as depicted in FIG. 2 and FIG. 3, the tray-engagement feature 204 includes (and is not limited to) a tray channel 214 defined by the paint tray 202. The applicator-engagement feature 404 includes (and is not limited to) a pin 412. The pin 412 extends from the shaft 408. The pin 412 is configured to be received, at least in part, by the tray channel 214.

In accordance with the embodiments as depicted in FIG. 2 and FIG. 3, the holder-engagement feature 104 includes (and is not limited to) a tray-engagement feature 204.

As depicted in the embodiment of FIG. 2, it will be appreciated that in accordance with a preferred embodiment, the paint holder 102 includes (and is not limited to) a paint tray 202, and the vertically-extending side wall 106 includes (and is not limited to) a vertically-extending tray side wall 206. The tray-engagement feature 204 is located on the vertically-extending tray side wall 206 of the paint tray 202.

In accordance with the embodiments as depicted in FIG. 2 and FIG. 3, the tray-engagement feature 204 includes (and is not limited to) a tray channel 214 defined by the vertically-extending tray side wall 206.

In accordance with the embodiments as depicted in FIG. 2 and FIG. 3, the tray-engagement feature 204 includes (and is not limited to) a tray channel 214 defined by the vertically-extending tray side wall 206. The applicator-engagement feature 404 includes (and is not limited to) a pin 412. The pin 412 extends from the shaft 408. The pin 412 is configured to be received, at least in part, by the tray channel 214.

In accordance with the embodiment as depicted in FIG. 2, the distance 403 between the outer surface of the paint roller 406 and the portion of the shaft 408 that bends approximately parallel to the outer surface of the paint roller 406 may be the same as the distance used in the existing (known) roller brush system, if so desired. The pin 412 is configured to securely selectively connect (attach) to a portion of the paint tray 202 (such as an end section of the paint tray 202, or from any one of the opposite end sections of the paint tray 202). Once the pin 412 of the paint applicator 402 is securely selectively connected to the portion of the paint tray 202, the paint applicator 402 may be laterally moved along a working surface 902. Specifically, the user 900, in use, orients the applicator-engagement feature 404 in such a way that the pin 412 is inserted into the tray channel 214.

In accordance with the embodiment as depicted in FIG. 3, once the pin 412 is inserted into the tray channel 214 (that is, the pin 412 and the tray channel 214 become selectively engaged with each other), the user 900 then pulls (drags, pulls, moves, etc.) the paint applicator 402 laterally or along a horizontal direction along the working surface 902, and as a result the paint holder 102 is moved along the working surface 902 as well (from one place to another place). It will be appreciated that instances of the tray channel 214 may be located or positioned on opposite end sections of the paint holder 102 (or the paint tray 202), etc., as the case may be. Referring to the embodiment as depicted in FIG. 2 (and in accordance with an option), the paint tray 202 includes a tray-engagement feature 502. The tray-engagement feature 502 extends upwardly from a top section of the paint tray 202. Preferably, the tray-engagement feature 502 extends from the vertically-extending tray side wall 206 of the paint tray 202. Details regarding the tray-engagement feature 502 are further described in the embodiment associated with FIG. 7.

Referring to the embodiment as depicted in FIG. 2, preferably, an extension shaft 411 is configured to be securely connectable to an end section of the handle 410.

Referring to the embodiment as depicted in FIG. 3, the paint tray 202 includes a bottom floor 216 configured to make contact with the working surface 902.

FIG. 4 and FIG. 5 depict perspective views of embodiments of the paint holder 102 of FIG. 2. In accordance with a preferred embodiment (as depicted in FIG. 4 and FIG. 5), the paint holder 102 includes (and is not limited to) a paint tray 202.

In accordance with the embodiments as depicted in FIG. 4 and FIG. 5, the bottom section of the paint tray 202 includes opposite elongated sliders 904 positioned along (at least in part) the bottom section of the opposite vertically-extending tray side wall 206. The elongated sliders 904 are configured to allow relatively easier sliding of the paint tray 202 along the working surface 902 (as depicted in FIG. 3), if so desired. The working surface 902 may include a top surface of a drop sheet placed on a horizontal floor surface.

In accordance with the embodiments as depicted in FIG. 4 and FIG. 5, the paint tray 202, preferably, includes a ledge portion 504. The ledge portion 504 extends laterally away from the outer surface of the paint tray 202. The ledge portion 504 is positioned about midway between the top section and the bottom section of the vertically-extending tray side wall 206. The ledge portion 504 is positioned at a corner of the paint tray 202 located proximate to the paint well of the paint tray 202. The tray-engagement feature 502 extends upwardly from the top section of the vertically-extending tray side wall 206 of the paint tray 202. Preferably, a spaced-apart pair of the tray-engagement feature 502 is located along the opposite sides walls of the paint tray 202.

FIG. 6 depicts a perspective view of an embodiment of the paint holder 102 of FIG. 2. In accordance with a preferred embodiment (as depicted in FIG. 6), the paint holder 102 includes (and is not limited to) a paint tray 202.

In accordance with the embodiment as depicted in FIG. 6, the ledge portion 504, in use, is configured to rest on a lip portion of a paint storage bin 906 (also called a paint can). The ledge portion 504, in use, permits relatively easier cleaning of the paint tray 202. In use, the ledge portion 504 rests on a ledge or rim section of the paint storage bin 906 so that the paint may be made to flow from the interior of the paint tray 202 to the interior of the paint storage bin 906 (by tipping the paint tray 202 once the ledge portion 504 is made to rest on the rim of the paint storage bin 906).

FIG. 7 depicts a perspective view of embodiments of the paint holder 102 of FIG. 2, and also depicts an embodiment of the paint applicator 402 of FIG. 1. In accordance with a preferred embodiment (as depicted in FIG. 7), the paint holder 102 includes (and is not limited to) any one, or both, of a paint tray 202 and a paint liner 302.

In accordance with the embodiment as depicted in FIG. 7, the holder-engagement feature 104 includes (and is not limited to) a liner-engagement feature 304. The paint holder 102 includes (and is not limited to) a paint liner 302, in which the liner-engagement feature 304 is located on the paint liner 302.

In accordance with the embodiment as depicted in FIG. 7, the liner-engagement feature 304 includes (and is not limited to) a liner channel 314 defined by the paint liner 302.

In accordance with the embodiment as depicted in FIG. 7, the liner-engagement feature 304 includes (and is not limited to) a liner channel 314 defined by the paint liner 302. The applicator-engagement feature 404 includes (and is not limited to) a pin 412, in which the pin 412 extends from the shaft 408. The pin 412 is configured to be received, at least in part, by the liner channel 314.

In accordance with the embodiment as depicted in FIG. 7, the holder-engagement feature 104 includes (and is not limited to) a liner-engagement feature 304. The paint holder 102 includes (and is not limited to) a paint liner 302.

Referring to the embodiment as depicted in FIG. 3, it will be appreciated that the vertically-extending side wall 106 includes (and is not limited to) a vertically-extending liner side wall 306, in which the liner-engagement feature 304 is located on the vertically-extending liner side wall 306 of the paint liner 302.

In accordance with the embodiment as depicted in FIG. 7, the liner-engagement feature 304 includes (and is not limited to) a liner channel 314 defined by the vertically-extending liner side wall 306.

In accordance with the embodiment as depicted in FIG. 7, the liner-engagement feature 304 includes (and is not limited to) a liner channel 314 defined by the vertically-extending liner side wall 306. The applicator-engagement feature 404 includes (and is not limited to) a pin 412, in which the pin 412 extends from the shaft 408. The pin 412 is configured to be received, at least in part, by the liner channel 314.

In accordance with the embodiment as depicted in FIG. 7, the holder-engagement feature 104 includes (and is not limited to) a tray-engagement feature 204, and a liner-engagement feature 304. The paint holder 102 includes (and is not limited to) a paint tray 202 and a paint liner 302. The tray-engagement feature 204 is located on the paint tray 202. The liner-engagement feature 304 is located on the paint liner 302. The paint liner 302 is configured to be received, at least in part, by the paint tray 202. The tray-engagement feature 204 and the liner-engagement feature 304 are configured to be co-aligned with each other once the paint liner 302 is received, at least in part, by the paint tray 202.

In accordance with the embodiment as depicted in FIG. 7 (and in accordance with an option), the paint tray 202 includes a tray-engagement feature 502. Preferably, the tray-engagement feature 502 extends upwardly from a top section of the paint tray 202. Preferably, the tray-engagement feature 502 extends from the vertically-extending tray side wall 206 of the paint tray 202. The paint liner 302 includes a liner-engagement feature 602. Preferably, the liner-engagement feature 602 is defined by the paint liner 302. Preferably, the liner-engagement feature 602 is positioned at the top portion of an end section of the paint liner 302. The tray-engagement feature 502 and the liner-engagement feature 602 are configured to be selectively securably engageable with each other once the paint liner 302 is received, at least in part, by the paint tray 202.

In accordance with the embodiment as depicted in FIG. 7, the paint liner 302 is configured to be received, at least in part, into the interior of the paint tray 202. The liner channel 314 and the tray channel 214 are configured to be positionable one over the other once the paint liner 302 is received, at least in part, into the interior of the paint tray 202.

In accordance with the embodiment as depicted in FIG. 7, the tray-engagement feature 502 (of the paint tray 202) and the liner-engagement feature 602 (of the paint liner 302) are configured to be selectively engageable with each other once the paint liner 302 is received, at least in part, into the interior of the paint tray 202. In this preferred manner, the pin 412 may engage both the tray-engagement feature 502 and the liner-engagement feature 602 (as depicted in the embodiment of FIG. 9).

FIG. 8 depicts a cross-sectional view (taken along the cross-sectional line B-B of FIG. 7) of embodiments of the paint holder 102 of FIG. 2, and also depicts an embodiment of the paint applicator 402 of FIG. 1. In accordance with a preferred embodiment (as depicted in FIG. 8), the paint holder 102 includes (and is not limited to) a paint liner 302.

In accordance with the embodiment as depicted in FIG. 8, the liner channel 314 is located on opposite end sections of the paint liner 302. The pin 412 is configured to be engageable with (preferably, receivable into) the pin 412 (once the user positions the paint applicator 402 accordingly, as depicted in the embodiment of FIG. 9).

FIG. 9 depicts a cross-sectional view (taken along a cross-sectional line A-A of FIG. 7) of embodiments of the paint holder 102 of FIG. 2, and also depicts an embodiment of the paint applicator 402 of FIG. 1. In accordance with a preferred embodiment (as depicted in FIG. 9), the paint holder 102 includes (and is not limited to) any one, or both, of a paint tray 202 and a paint liner 302.

In accordance with the embodiment as depicted in FIG. 9, the liner channel 314 is positioned overtop the tray channel 214 (once the paint liner 302 is received, at least in part, by the paint tray 202). Once the pin 412 is received in the liner channel 314 and the tray channel 214, the user 900 may pull (move, push, etc.) the paint applicator 402, which then moves the paint tray 202 along the working surface 902 (along a horizontal direction along the working surface 902).

FIG. 10 and FIG. 11 depict perspective views of embodiments of the paint holder 102 of FIG. 2, and also depict embodiments of the paint applicator 402 of FIG. 1. In accordance with the preferred embodiments (as depicted in FIG. 10 and FIG. 11), the paint holder 102 includes (and is not limited to) any one, or both, of a paint tray 202 and a paint liner 302.

In accordance with the embodiments as depicted in FIG. 10 and FIG. 11, the paint liner 302 is flipped upside down, and the paint liner 302 is positioned to cover the interior of the paint tray 202. In this manner, the paint liner 302 may be utilized as a dome, and the paint and paint applicator 402 (held by the paint tray 202) may then be kept reasonably wet (moist) for several days without having to remove the paint from the interior of the paint tray 202. The paint applicator 402 extends in part outwardly from the paint liner 302 and the paint tray 202 (while in this storage mode). In accordance with an option, the paint tray 202 has opposite elongated sliders 904 (oriented on the opposite vertically-extending tray side wall 206). The elongated sliders 904 are configured to facilitate relatively easier sliding.

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a paint holder configured for utilization with a paint applicator, in which the paint applicator has an applicator-engagement feature; and the paint holder having a paint-receiving zone configured to receive paint therein; and the paint holder having a vertically-extending side wall, in which the vertically-extending side wall surrounds, at least in part, the paint-receiving zone; and the paint holder having a holder-engagement feature configured to selectively engage with, and selectively disengage from, the applicator-engagement feature of the paint applicator in such a way that the paint holder is movable from one place to another place in response to a user, in use, moving the paint applicator while the paint holder, in use, receives and holds the paint, and while the paint holder and the paint applicator remain selectively engaged with each other, and while the user continues to grasp the paint applicator; and wherein:

the paint holder includes a paint tray having a bottom section including opposite elongated sliders positioned along, at least in part, the bottom section of the opposite vertically-extending tray side wall, and the elongated sliders are configured to allow relatively easier sliding of the paint tray along the working surface; and the vertically-extending side wall includes a vertically-extending tray side wall spanning between the opposite elongated sliders of the paint tray; and the holder-engagement feature is positioned at a top portion of the vertically-extending tray side wall; and the paint applicator includes a paint roller, a shaft, and a handle, and the shaft extends from an end portion of the handle, and the paint roller is configured to be selectively rotatably mounted to the shaft; and the applicator-engagement feature includes a pin, and the pin extends from a side portion of the shaft; and the shaft includes a V-shaped shaft portion that faces and opens laterally away from one end portion of the paint roller; and the pin is fixedly connected to, and extends from, about the middle of the V-shaped shaft portion; and the pin extends laterally away from one end portion of the paint roller; and the pin is aligned parallel to the lateral axis that extends between opposite ends of the paint roller; and the V-shaped shaft portion is shaped to protect and guard the pin from inadvertent and unwanted damage; and the holder-engagement feature is located midway between the opposite elongated sliders of the paint tray, at an end section of the paint holder in such a way that the holder-engagement feature permits a user to pull the paint applicator, which moves the opposite elongated sliders of the paint tray along a horizontal direction along the working surface.

2. An apparatus, comprising:

a paint applicator configured for utilization with a paint holder, in which the paint holder has a paint-receiving zone configured to receive paint therein, and in which the paint holder has a vertically-extending side wall surrounding, at least in part, the paint-receiving zone, and the paint holder having a holder-engagement feature; and the paint applicator having an applicator-engagement feature configured to selectively engage with, and selectively disengage from, the holder-engagement feature of the paint holder in such a way that the paint applicator is usable, by a user, for moving the paint holder from one place to another place while the paint holder, in use, receives and holds the paint, and while the paint holder and the paint applicator remain selectively engaged with each other, and while the user continues to grasp the paint applicator; and wherein:

the paint holder includes a paint tray having a bottom section including opposite elongated sliders positioned along, at least in part, the bottom section of the opposite vertically-extending tray side wall, and the elongated sliders are configured to allow relatively easier sliding of the paint tray along the working surface; and the vertically-extending side wall includes a vertically-extending tray side wall spanning between the opposite elongated sliders of the paint tray; and the holder-engagement feature is positioned at a top portion of the vertically-extending tray side wall; and the paint applicator includes a paint roller, a shaft, and a handle, and the shaft extends from an end portion of the handle, and the paint roller is configured to be selectively rotatably mounted to the shaft; and the applicator-engagement feature includes a pin, and the pin extends from a side portion of the shaft; and the shaft includes a V-shaped shaft portion that faces and opens laterally away from one end portion of the paint roller; and the pin is fixedly connected to, and extends from, about the middle of the V-shaped shaft portion; and the pin extends laterally away from one end portion of the paint roller; and the pin is aligned parallel to the lateral axis that extends between opposite ends of the paint roller; and the V-shaped shaft portion is shaped to protect and guard the pin from inadvertent and unwanted damage; and the holder-engagement feature is located midway between the opposite elongated sliders of the paint tray, at an end section of the paint holder in such a way that the holder-engagement feature permits a user to pull the paint applicator, which moves the opposite elongated sliders of the paint tray along a horizontal direction along the working surface.

* * * * *